US007726599B2

(12) United States Patent
Lewis et al.

(10) Patent No.: US 7,726,599 B2
(45) Date of Patent: Jun. 1, 2010

(54) APPARATUS AND METHOD FOR DISPENSING SHEET MATERIAL

(75) Inventors: Richard Paul Lewis, Marietta, GA (US); Paul Francis Tramontina, Alpharetta, GA (US); David W. Kapiloff, Gainesville, GA (US); Stephen L. Phelps, Lilburn, GA (US); Darrell R. Johnson, Woodstock, GA (US); Gerald L. Clark, Nicholson, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 1179 days.

(21) Appl. No.: 10/750,238

(22) Filed: Dec. 31, 2003

(65) Prior Publication Data

US 2005/0145745 A1 Jul. 7, 2005

(51) Int. Cl.
*A47K 10/38* (2006.01)

(52) U.S. Cl. ..... 242/563; 242/563.2; 242/564.4

(58) Field of Classification Search ..... 242/563, 242/563.2, 564, 564.1, 564.3, 564.4, 565; 312/34.22, 34.8; 83/649
See application file for complete search history.

(56) References Cited

U.S. PATENT DOCUMENTS

| | | | |
|---|---|---|---|
| 4,131,044 | A | 12/1978 | Cassia |
| 4,611,768 | A | 9/1986 | Voss et al. |
| 4,666,099 | A | 5/1987 | Hoffman et al. |
| 4,676,131 | A | 6/1987 | Cassia |
| 4,721,265 | A | 1/1988 | Hawkins |
| 4,738,176 | A | 4/1988 | Cassia |
| 4,757,337 | A | 7/1988 | Shikaumi |
| 4,765,555 | A | 8/1988 | Gambino |
| 4,786,005 | A | 11/1988 | Hoffman et al. |
| 4,790,490 | A | 12/1988 | Chakravorty |
| 4,796,825 | A | 1/1989 | Hawkins |

(Continued)

FOREIGN PATENT DOCUMENTS

| | | |
|---|---|---|
| WO | WO 02/48955 | 6/2002 |

OTHER PUBLICATIONS

ASTM Designation: D 3776-96, "Standard Test Method for Mass Per Unit Area (Weight) of Fabric", Published Jun. 1996, pp. 86-89.

(Continued)

*Primary Examiner*—John Q Nguyen
*Assistant Examiner*—Scott Haugland
(74) *Attorney, Agent, or Firm*—Dority & Manning, PA.

(57) ABSTRACT

A sheet material dispenser includes a controller for automatically controlling the lengths of sheet materials dispensed from a continuous roll by identifying the type of sheet materials on the roll and dispensing suitable lengths of the identified sheet material. The dispenser desirably has a support for rotatably supporting a roll of sheet material carrying identification relating to the type of sheet material on the roll, and an identifier positioned in or adjacent the dispenser for identifying the type of sheet material on the roll. A processor receives data from the identifier, processes the data and generates an output command, and a controller controls the lengths of sheet material dispensed from the roll in response to the output command. In this way, more absorbent products may be dispensed in shorter lengths and less absorbent products may be dispensed in longer lengths.

13 Claims, 9 Drawing Sheets

U.S. PATENT DOCUMENTS 4,817,483 A 4/1989 Armbruster
4,826,262 A 5/1989 Hartman et al.
4,960,248 A 10/1990 Bauer et al.
5,107,734 A 4/1992 Armbruster
5,131,302 A 7/1992 Watanabe
5,205,454 A 4/1993 Schutz et al.
5,452,832 A 9/1995 Niada
5,604,992 A 2/1997 Robinson
5,620,148 A 4/1997 Mitchell
5,772,291 A 6/1998 Byrd et al.
5,934,167 A * 8/1999 Yamamoto ..... 83/650
6,069,354 A 5/2000 Alfano et al.
6,079,035 A 6/2000 Suzuki et al.
6,079,305 A 6/2000 Bloch et al.
6,105,898 A 8/2000 Byrd et al.
6,250,530 B1 6/2001 LaCount et al.
6,259,367 B1 7/2001 Klein
6,293,486 B1 9/2001 Byrd et al.
6,321,963 B1 11/2001 Gracyalny et al.
6,354,493 B1 3/2002 Mon
6,354,533 B1 3/2002 Jespersen
6,362,738 B1 3/2002 Vega
6,363,057 B1 3/2002 Ardalan et al.
6,411,920 B1 * 6/2002 McConnell et al. ..... 702/177
6,412,655 B1 7/2002 Stuetzel et al.
6,412,679 B2 7/2002 Formon et al.
6,419,136 B2 7/2002 Formon et al.
6,451,154 B1 9/2002 Grabau et al.
6,592,067 B2 7/2003 Denen et al.
6,607,160 B2 8/2003 Lewis et al.
6,685,074 B2 2/2004 Gracyalny et al.
6,695,246 B1 2/2004 Elliott et al.
6,710,606 B2 3/2004 Morris
6,894,711 B2 * 5/2005 Yamakawa et al. ..... 347/221
6,923,581 B2 * 8/2005 Ueda et al. ..... 400/61
6,962,451 B2 * 11/2005 Narita et al. ..... 400/207
2002/0050544 A1 5/2002 Stanland et al.
2002/0109034 A1 8/2002 Moody et al.
2002/0109035 A1 8/2002 Denen et al.
2002/0117578 A1 8/2002 Denen et al.
2003/0025027 A1 * 2/2003 Ebisawa et al. ..... 242/525.4
2003/0167893 A1 9/2003 Morris et al.
2003/0168489 A1 9/2003 Formon et al.
2003/0168549 A1 9/2003 Formon et al.
2003/0168550 A1 9/2003 Formon et al.
2004/0035976 A1 2/2004 Byrd et al.
2004/0041057 A1 3/2004 Byrd et al.

OTHER PUBLICATIONS

TAPPI Official Test Method T 220 sp-96, "Physical Testing of Pulp Handsheets," published 1996, pp. 1-6.

* cited by examiner

Check Dispenser Status Routine
530

532
Delay Flag Set ?
YES
NO
534
Check Delay Counter Value
538
Service Delay Counter Value
542
Check Paper Sensor
540
Reset Delay Flag
YES
Delay Count Reached ?
NO
536
544
Paper Out ?
YES
546
Set Status-Off-Line Flag
NO
548
Check Door Sensor
550
Door Open?
YES
552
1. Set Status-Off-Line Flag;
2. Execute Paper Routine
NO
554
1. ReSet Status-Off-Line Flag;
2. Detect and Issue Warnings;
RETURN

APPARATUS AND METHOD FOR DISPENSING SHEET MATERIAL

BACKGROUND OF THE INVENTION

The present invention relates to the dispensing of sheet material. More specifically, the invention relates to an apparatus for dispensing predetermined lengths of sheet material.

Sheet material dispensers for dispensing, for example, but not by way of limitation, paper towels, generally include a housing, and a supply of sheet material within the housing in the form of individual sheets, folded sheets, festooned sheets, or a roll of sheet material which can be dispensed as individual sheet materials, such as, for example only, paper towels. Roll towel dispensers typically include a mechanism for advancing sheets or unrolling the sheet material roll. In some dispensers, the mechanism includes a lever or a crank for manually dispensing sheet material from the roll, and the dispenser housing often carries a blade for cutting the lengths of sheet material from the roll. Manual contact with a dispenser lever or one or more sheets touched by another user can be a health hazard for a user, especially in certain environments such as, by way of non-limiting example, in hospitals, and so forth.

Further, another disadvantage of sheet dispensers is that the softness and absorbency characteristics of the sheet material, or lack thereof, are limited by the mechanical and/or electrical limitations of the dispenser. That is, the dispenser has a predetermined setting which provides the same amount of sheet material to a user, whether or not the sheet material is a soft, highly absorbent sheet material, or whether the sheet material has a much lower absorbency.

A sheet material which is soft and highly absorbent only requires, for example, about eleven to twelve inches, or less, of sheet material per hand drying even to sufficiently dry a user's hands to the user's satisfaction. A sheet which is not highly absorbent may require fourteen inches, eighteen inches, or more to sufficiently dry a user's hands to the user's satisfaction. When a dispenser is preset to dispense, for example, about twelve inches of sheet material, it may satisfy a user if highly absorbent. However, if the sheet material is low absorbency, it will likely result in the user obtaining at least another twelve (12) inch sheet. This results in waste, higher costs to maintain sheet material in the dispenser, and a greater environmental impact.

Some dispensers allow a change in length of the sheet material dispensed by a manual manipulation of the dispenser prior to the introduction of a new roll of sheet material. A disadvantage with these dispensers is that they require an operator to manually adjust the sheet material length during replacement of a roll. Apart from requiring time, effort and expertise from the operator, there is the risk of human error in the resetting operation.

Accordingly, there remains a need in the art for a sheet material dispenser which automatically dispenses different lengths of sheet material based on characteristics of the sheet material, such as absorbency, and so forth. Desirably, such a sheet material dispenser would recognize the sheet material, and would dispense an appropriate amount in one sheet to satisfy a user's hand drying needs, but limit cost and waste.

SUMMARY OF THE INVENTION

The present invention provides a sheet material dispenser which controls the lengths of sheet material dispensed from a continuous roll by identifying the type of sheet material on the roll and dispensing suitable lengths of the identified sheet material. The dispenser desirably may include a support for supporting sheet material carrying identification relating to the type of sheet material, and an identifier in or adjacent the dispenser for identifying the type of sheet material. A processor receives data from the identifier, processes the data and generates an output command, and a controller controls the lengths of sheet material dispensed from the roll in response to the output command. In this way, more absorbent products can be dispensed in shorter lengths and less absorbent products in longer lengths.

The identifier may be a reader or scanner which reads data from identification on the sheet material or on a core of the sheet material roll. In this case, the identification may comprise a label, a logo, a bar code, a magnetic strip, a radio frequency identification device (RFID) such as a "smart" tag or chip, or a hologram on the roll of sheet material. Desirably, the identification on the roll of sheet material is encoded, and the dispenser includes a decoder for decoding the encoded data.

Alternatively, the identifier may comprise an infrared emitter/detector circuit which is arranged to emit infrared light into the core of the sheet material roll, and to detect reflection of the light off reflective identification on the core of the roll.

The broad scope of the applicability of the present invention will become apparent to those of skill in the art from the details given below.

The detailed description of the preferred embodiments of the invention is given by way of example only, and various modifications within the scope of the invention will be apparent to those of skill in the art.

DEFINITIONS

Figure 1:
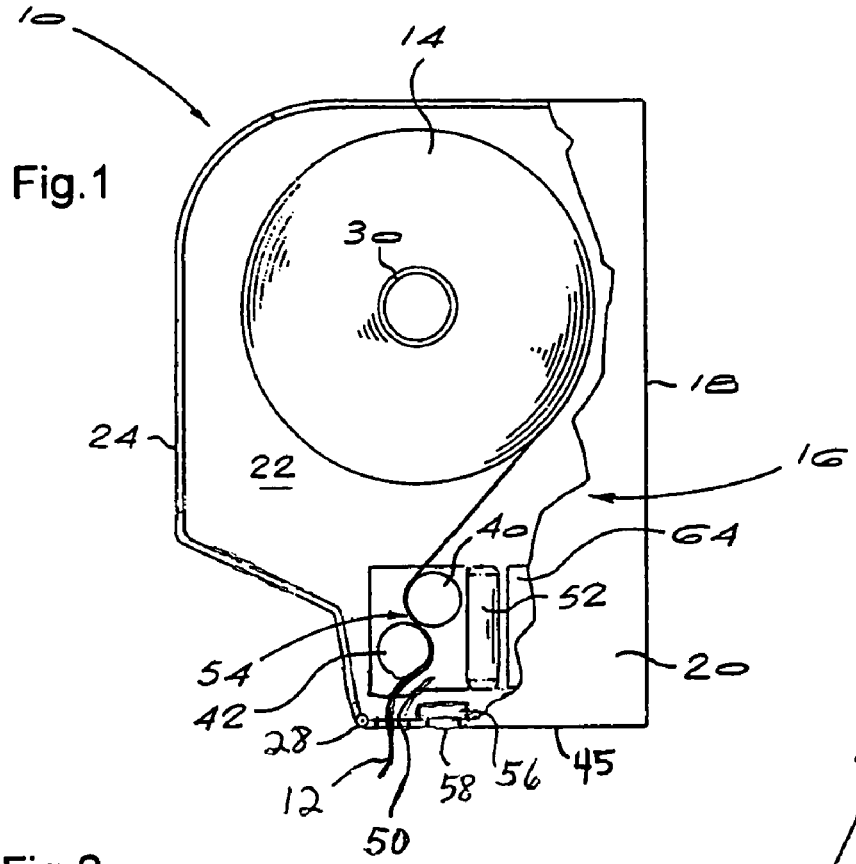
FIG. 1 is a side view, partially in cross-section, of a sheet material dispenser according to an embodiment of the present invention.

As used herein, the term "identification" when used as a noun means anything on an object which serves to identify the object.

As used herein, the term "identifier" means a mechanism or a device for identifying an object from identification on the object.

As used herein, the term "comprising" is intended to be inclusive or open-ended, and is not intended to exclude additional elements or method steps Which do not prevent operation of the invention.

As used herein, the term "fasteners" means devices that fasten, join, connect, secure, hold, or clamp components together. Fasteners include, but are not limited to, screws, nuts and bolts, rivets, snap-fits, tacks, nails, loop fasteners, and interlocking male/female connectors, such as fishhook connectors, a fish hook connector includes a male portion with a protrusion on its circumference. Inserting the male portion into the female portion substantially permanently locks the two portions together.

As used herein, the term "basis weight" (hereinafter may be referred to as "BW") is the weight per unit area of a sample and may be reported as grams per meter squared (gsm). The basis weight may be measured using test procedure ASTM D 3776-96 or TAPPI Test Method T-220.

As used herein, the term "hinge" refers to a jointed or flexible device that connects and permits pivoting or turning of a part to a stationary component. Hinges include, but are not limited to, metal pivotable connectors, such as those used to fasten a door to frame, and living hinges. Living hinges may be constructed from plastic and formed integrally between two members. A living hinge permits pivotable movement of one member in relation to another connected member.

As used herein, the term "couple" includes, but is not limited to, joining, connecting, fastening, linking, or associating two things integrally or interstitially together.

As used herein, the terms "sheet material" and "paper" means a material that is thin in comparison to its length and breadth. Generally speaking, sheet materials should exhibit a relatively flat planar configuration and be flexible to permit folding, rolling, stacking, and the like. Exemplary sheet materials and papers include, but are not limited to, paper tissue, bath/toilet tissue, paper towels, wipes, label rolls, or other fibrous, film, polymers, or filamentary products. The terms "sheet material" and "paper" may be used interchangeably.

These terms may be defined with additional language in the remaining portions of the specification.

DETAILED DESCRIPTION OF THE INVENTION

Reference will now be made in detail to one or more embodiments of the invention, examples of which are illustrated in the drawings. Each example and embodiment is provided by way of explanation of the invention, and is not meant as a limitation of the invention. For example, features illustrated or described as part of one embodiment may be used with another embodiment to yield still a further embodiment. It is intended that the invention include these and other modifications and variations as coming within the scope and spirit of the invention.

FIG. 1 of the drawings illustrates a dispenser 10 for dispensing a web of sheet material 12 from a continuous roll 14 according to one embodiment of the present invention. The web of sheet material in this embodiment comprises an absorbent material, such as paper towelling, and so forth, which may be periodically perforated for separation.

Figure 2:
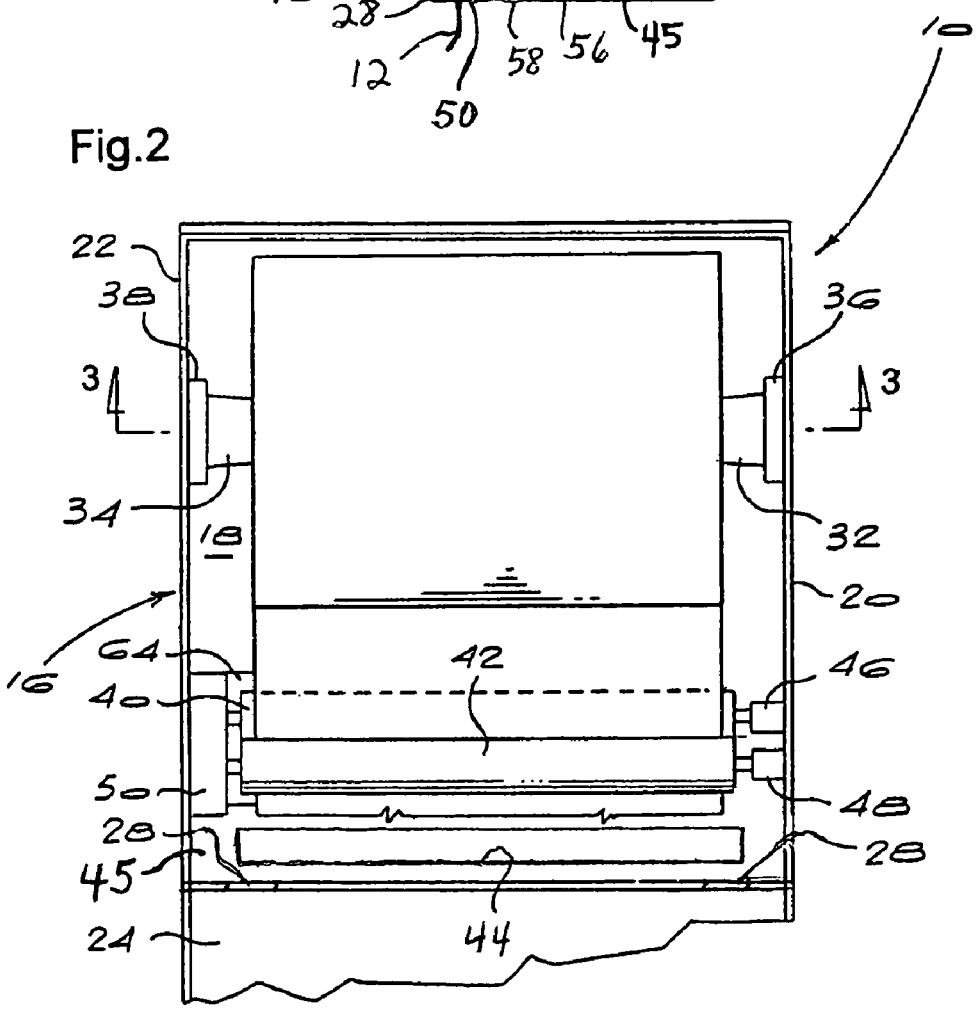
FIG. 2 is a front view of a portion of the dispenser of FIG. 1 in an open condition.

With reference also to FIG. 2 of the drawings, the dispenser 10 is seen to include a dispenser housing 16 having a back panel 18 mountable to a wall or similar vertical surface, a pair of opposed side panels 20 and 22, and a front cover 24. The front cover 24 is desirably, but not by way of limitation, pivotally connected to a lower portion of the housing 16 with hinges 28 so as to be movable between a closed condition, as illustrated in FIG. 1, and an open condition, as illustrated in FIG. 2. It will be appreciated that the front cover 24 may be connected by fasteners, screws, and any other mechanism known in the art. The front cover 24 of the dispenser housing 16 typically is opened for servicing or for loading a replacement sheet material roll into the dispenser 10. A latch (not shown) allows the front cover 24 to be locked in the closed condition so as to avoid unauthorised tampering with the dispenser components within the housing 16.

Figure 7:
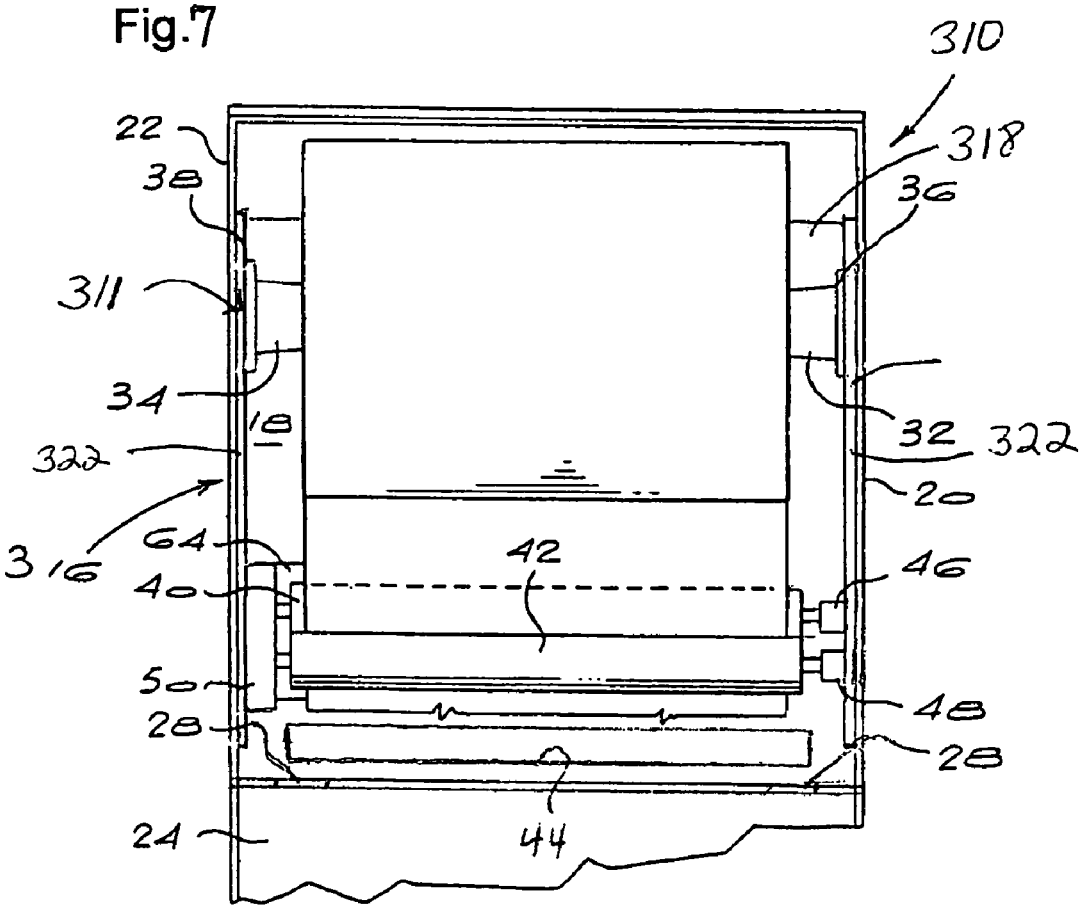
FIG. 7 is a front view of a portion of the dispenser of FIG. 1 in an open condition, showing a module which is inserted into the dispenser housing of the present invention.

The sheet material roll 14 desirably includes a core or sleeve 30. The sheet material roll 14 may, alternatively, be a coreless roll, such as that disclosed in U.S. Pat. No. 5,620,148 to J. Mitchell, which is hereby incorporated by reference in its entirety herein for all purposes. The sheet material roll 14 is desirably rotatably supported within the housing 16 by a pair of mounting hubs 32 and 34 which, in the present embodiment, are illustrated as connected to the side panels 20 and 22 of the housing 16 by means of roll holders 36 and 38. It will be appreciated, however, that the housing 16 may be provided as a separate unit with few or no mechanisms connected thereto. In this instance, some or all of the dispensing mechanisms shown and/or described herein may be provided as one or more modules which are inserted into the housing, as illustrated in FIG. 7. Examples of such dispenser housings and modules are disclosed in U.S. Pat. Nos. 4,131,044 and 6,079,035, both of which are incorporated by reference in their entirety herein for all purposes.

As can be seen, the sheet material 12 runs off the roll 14, between a pair of rollers 40 and 42, and through a dispensing opening 44, for example, in a lower end 45 of the housing 16. Alternatively, the dispensing opening may be formed in the front cover, or in both a portion of the front cover and a portion of the lower end (not shown). The opening 44 may have a serrated edge (not illustrated), or it may carry teeth (also not illustrated) for severing the web of sheet material. One end of the roller 40 may be rotatably mounted to the side panel 20 of the housing 16 or of a module housing (FIG. 7) by means of a roll holder 46, and one end of the roller 42 may be rotatably mounted to the side panel 20 of the housing 16 or of a module housing (FIG. 7) by means of a roll holder 48. The other ends of the rollers 40 and 42 may be rotatably mounted to the side panel 22 by means of roll holders concealed within a transmission housing 50. The transmission housing 50 contains a transmission (not visible) for transmitting drive from an electric motor 52 to the roller 40 so as to rotate this roller. Alternatively, at least one of the rollers may be mounted in the front cover, as disclosed generally in U.S. Pat. No. 6,607,160 which is incorporated by reference in its entirety herein for all purposes.

The rollers 40 and 42 together define a nip 54 having a gap which is desirably slightly smaller than the thickness of the sheet material on the roll 14. The sheet material 12 passes through the nip 54, as shown most clearly in FIG. 1, so that rotation of the drive roller 40 and the driven roller 42 pulls the sheet material off of the roll 14 and dispenses it through the dispensing opening 44.

An activation sensor 56 may be mounted to the lower end 45 of the housing 16 (or, alternatively, to a module in the housing (not shown)) adjacent a lens 58, as illustrated in FIG. 1. It will be understood, however, that the activation sensor 56 and/or lens 58, or any activations system shown and/or described herein or known in the art, may be mounted in any area of the housing, so long as it operates as described herein. In this embodiment of the invention, the sensor 56 is desirably, but not by way of limitation, a conventional passive sensor for detecting infrared radiation. Passive infrared detectors are known in the art, and are described, for example, in U.S. Pat. No. 4,757,337 to Shikaumi and U.S. Pat. No. 4,960,248 to Bauer et al, both of which are incorporated herein by reference. A passive infrared detector which may be used with the dispenser 10 is a Model 40623 sold by Eltec Instruments Inc. However, those of skill in the art will appreciate that various different infrared detectors are available, and that many of the available detectors are suitable for use with the dispenser 10. In practice, the sensor 56 is arranged to detect infrared radiation from a user's hand placed below the lens 58, and upon detecting the radiation, to transmit a signal for activating the electric motor 52 so as to dispense a length of sheet material through the dispensing opening 44.

It will by understood, however, that other activation mechanisms, such as capacitive and ultrasonic, may be used in the present invention. Capacitive proximity sensors produce an electrostatic field that will sense both metal objects and non-metallic materials such as paper, glass, liquids and cloth. Ultrasonic proximity sensors use a transducer to send and receive high frequency sound signals. When a target enters the beam the sound is reflected back to the sensor, causing it to energize or de-energize the output circuit. Another sensor type is inductive. In this case an electromagnetic field is used, however, detection is limited to only metallic objects.

Figure 3:
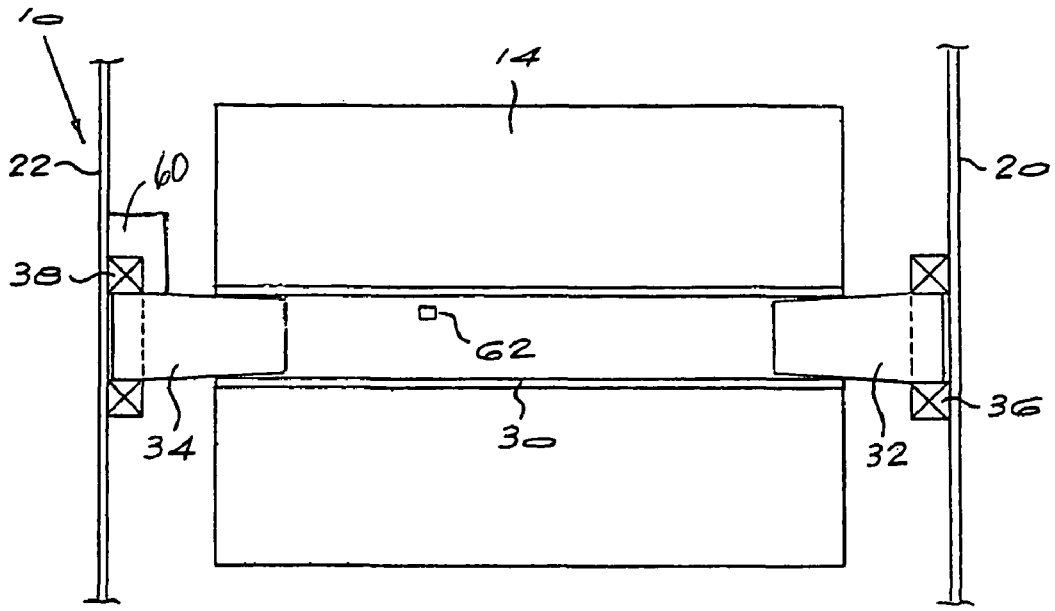
FIG. 3 is a cross-sectional view along the line 3-3 in FIG. 2.

With particular reference now to FIG. 3 of the drawings, the dispenser 10 includes a reader or scanner 60 positioned in a non-limiting example on the housing 16 or module (FIG. 7), and by way of another non-limiting example, the core 30 of the roll 14 carries identification in the form of a Radio Frequency Identification Device (RFID), which in this embodiment comprises a passive "smart" chip or tag 62. It will be understood that the reader or scanner 60 may be positioned on any portion of the dispenser, or near the dispenser, which permits it to operate in the manner shown and described herein. Similarly, it will be appreciated that the smart tag 62 may be positioned on any location, or a number of locations, on the sheet material.

The smart tag 62 contains information relating to the type of sheet material on the roll 14, for example information relating to the absorbency, the basis weight, etc. of the sheet material 12. In use, the scanner 60 interrogates the smart tag 62 with an electronic signal, and the smart tag 62, which includes an internal antenna (not visible), in turn generates and transmits an electromagnetic pulse that is readable by the scanner to identify the type of sheet material on the roll 14. The scanner 60 typically is configured to retrieve information from the smart tag 62 and to decode the information.

RFID smart tag technology is known and understood by those skilled in the art, and a detailed explanation thereof is not necessary for purposes of describing the dispenser and method of the present invention. Generally, conductive or passive smart tags consist of silicone or other semiconductors, a coiled, etched, or stamped antenna, a capacitor, and a substrate on which the components are mounted or embedded. A protective covering typically is used to encapsulate and seal the substrate. Inductive or passive smart tags have been introduced by Motorola under the name BISTATIX®. A detailed description of the BISTATIX® device may be found in U.S. Pat. No. 6,259,367 to Klein, the entire contents of which is incorporated herein by reference. Further information on smart tags and related technology is disclosed in U.S. Pat. No. 6,451,154 to Grabau et al; U.S. Pat. No. 6,354,493 to Mon; U.S. Pat. No. 6,362,738 to Vega; and PCT publication WO 02/48955. Various different RFID tags and scanners are available. RFID tags and scanners suitable for use with the dispenser 10 are available from, for example, Philips Semiconductors of Eindhoven, The Netherlands; Sokymat of Lausanne, Switzerland; Checkpoint Systems Inc. of Miami, Fla.; and Omron Company of Tokyo, Japan.

Alternatively, the smart tags 62 may be an active device. In this configuration, the smart tag 62 includes active transceiving circuitry that has the capability to selectively respond to coded request signals transmitted by a scanner. An active smart tag 62 may include the capability to receive and store additional information beyond the information contained in its fixed code. An active smart tag 62 requires an internal power supply, such as a micro-battery, thin film battery, and so forth (not shown).

The dispenser housing 16 desirably contains at least one battery 64 (see FIGS. 1 and 2) for powering the various electric and electronic components within the dispenser 10. It will be appreciated, however, that more than one, that is, a plurality of batteries may be used. Alternatively, however, the dispenser may be powered by AC or an AC powered transformer adapter.

Figure 4:
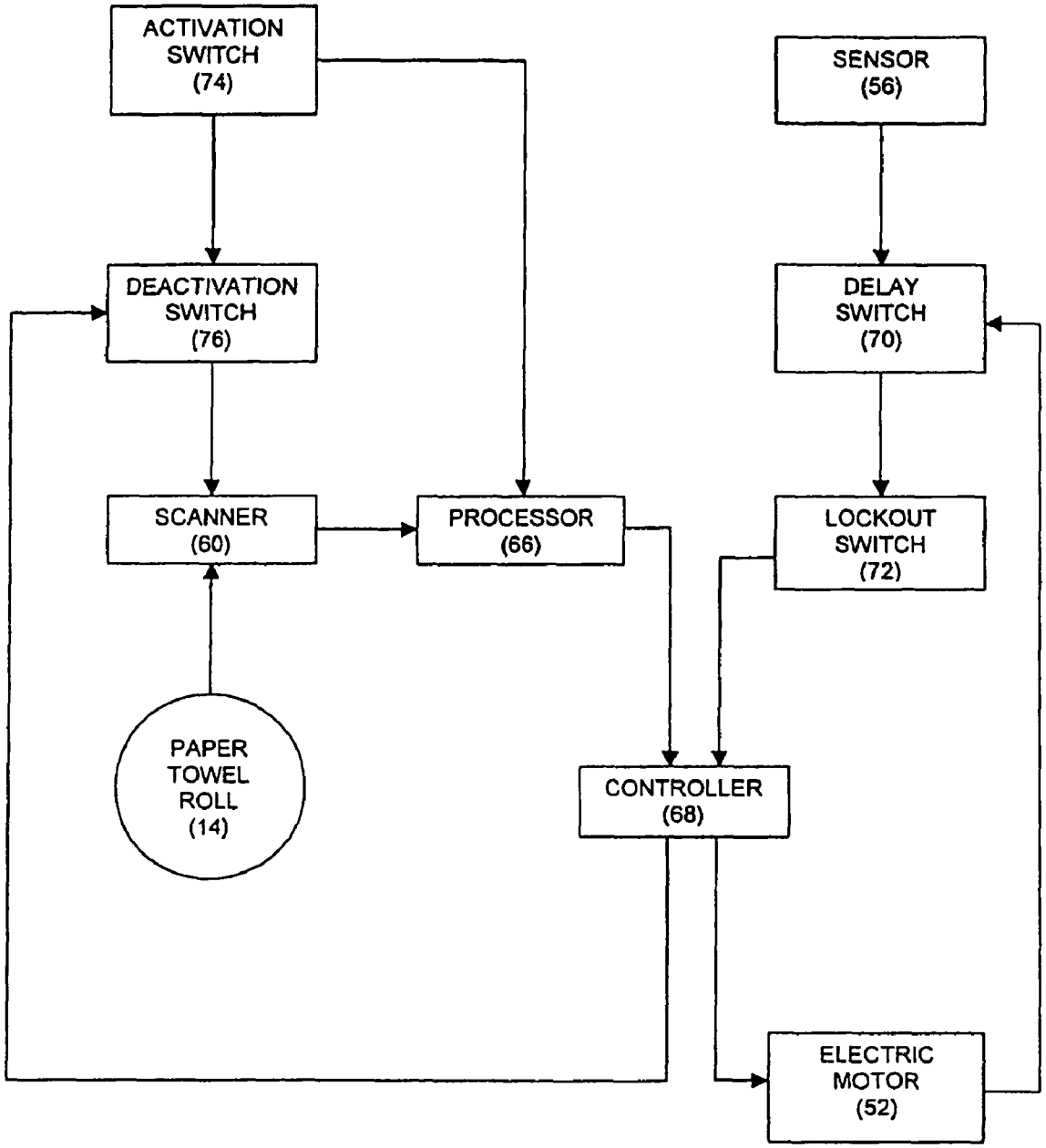
FIG. 4 is a block diagram of the dispenser illustrated in FIG. 1.

Referring now to FIG. 4 of the drawings, the dispenser 10 includes a processor 66 which receives data from the scanner 60 relating to the type of sheet material on the roll 14. The processor 66 contains an algorithm, which in this embodiment is stored in a chip set embedded on a printed circuit board within the dispenser housing 16, and which is used to process the data from the scanner 60 and to generate an output command for a controller 68. The controller in turn controls the operation of the electric motor 52, and hence the dispensing of the sheet material 12, in a manner which is described in more detail below.

A delay switch 70 is desirably provided for ensuring a minimum delay of, for example, but not by way of limitation, three seconds between successive activations of the electric motor 52. This delay is designed to avoid accidental reactivation of the electric motor, and hence unnecessary dispensing of sheet material by a user. The dispenser 10 also desirably includes a lockout switch 72 which opens when the front cover 24 is pivoted away from the closed condition, so as to prevent communication between the sensor 56 and the controller 68. This prevents operation of the electric motor 52 while the dispenser 10 is open. When the front cover 24 is returned to the closed condition, the lockout switch 72 automatically closes to allow operation of the controller 68 and the electric motor 52. In this way, the switch 72 protects an operator from moving components within the housing 16 during servicing or replacement of the roll of sheet material.

An activation switch 74 closes when the front cover 24 is opened, thereby desirably activating the scanner 60. This allows the scanner to read information from the smart tag 62 when the roll 14 is inserted into the dispenser 10. A deactivation switch 76 is also provided for deactivating the scanner 60, to conserve energy, after a predetermined number of revolutions of the drive roller 40, for example 9, or a predetermined number of activations of the electric motor 52, for example 3. It will be understood that any number of revolutions or activations may be set for the deactivation switch.

Alternatively, the dispenser 10 may be equipped with a reset system, e.g., a front cover 24 mounted switch that would trip when the front cover 24 was opened for reloading (not shown). In another alternative, a switch could be provided in connection with a fuel gauge which would trip when the fuel gauge goes to a full zero positions, such as when a product roll is replaced (not shown). Once the system is reset, its reading or sensing circuit would be enabled for a discrete or limited increment, for example, three rotations of the drive roller. After this interval and sensing of the product, the reading or sensing system would shut down until the next reset to conserve power. In still another alternative, a momentary contact switch may be provided in conjunction with, for example, one arm of the roll holder, such that movement of the arm, to load a new roll of sheet material, energizes the reading or sensing circuit.

The operation of the dispenser 10 will now be described with reference to FIG. 4. First, upon opening the front cover 24 of the dispenser housing 16 for the replacement of the sheet material 12, the activation switch 74 desirably closes to activate the scanner 60. The scanner then reads and decodes information relating to the type of sheet material 12 on the replacement roll 14 from the smart tag 62, and transmits data relating to the type of sheet material to the processor 66. The processor receives the data, processes the data, and generates an output command for adjusting the setting of the controller 68, which in turn controls the electric motor 52 so as to dispense a suitable length of sheet material. In this way, the lengths of sheet material 12 metered or dispensed vary according to the type of sheet material 12 on the roll 14. For example, the dispenser 10 may be set to dispense three different types of sheet material A, B and C having different degrees of softness and absorbency. If the towel A is the most absorbent and the towel C is the least absorbent, the processor 66 typically is set to generate output commands for adjusting the controller 68 so as to dispense shorter lengths of towel A than towel C. For example, the controller 68 may be adjustable to dispense 12 inches of sheet material A, 14 inches of sheet material B, and 18 inches of sheet material C. In this way, higher quality, more absorbent sheet material is efficiently dispensed without significant waste, while lower quality, less absorbent sheet material is dispensed in sufficiently long lengths to effect proper drying of a user's hands. A desired result is to provide one sheet of material to dry a user's hands; the length provided is meant to provide adequate dryness, based on characteristics of the sheet material, such as absorbency, basis weight, and so forth, so that a user only uses one sheet per hand drying episode.

Once the controller 68 has been set and the front cover 24 has been closed (and desirably locked), sheet material 12 is dispensed to a user upon triggering of the sensor 56. In this regard, when the sensor 56 detects a user's hand, it transmits a signal to the controller 68, through the switches 70 and 72, and the controller then activates the electric motor 52 to dispense the predetermined length of sheet material to the user. In this embodiment of the invention, the controller 68 desirably includes a counter which limits the number of revolutions of the electric motor 52 to effect dispensing of the desired length of sheet material to the user. The delay switch 70 is opened upon deactivation of the electric motor 52 by the controller 68, and this switch remains open for a predetermined time interval, for example, but not by way of limitation, 3 seconds, to block communication between the sensor 56 and the controller 68. In this manner, the delay switch 70 desirably prevents accidental reactivation of the motor 52 by a user removing sheet material 12 from the dispenser 10, and hence unnecessary dispensing of the sheet material. The delay switch 70 also serves to discourage vandals by frustrating bulk dispensing.

When an operator opens the front cover 24 to replace the roll 14, the activation switch 74, by way of non-limiting example, once again activates the scanner 60 so as to allow for the reading of a smart tag on a replacement roll of sheet material inserted into the dispenser 10. In the event that the replacement roll comprises a different sheet material to the previous roll, the processor 66 generates a new output command for adjusting the setting of the controller 68, and hence the length of sheet material to be dispensed by the electric motor 52. Also, as soon as the front cover 24 of the dispenser housing 16 is opened, the lockout switch 72 opens to prevent operation of the electric motor 52, thereby to protect the operator from moving components within the housing 16.

In the event that an unrecognized roll of sheet material ("unrecognized roll", "unrecognized sheet material" and/or "unrecognized paper" as used herein refers to a roll of sheet material which is scanned and either (1) does not send back the expected signal, or (2) does not send back any signal) is loaded into the dispenser 10, and the scanner 60 is unable to read and/or receive information relating to the type of sheet material on the roll, the processor 66 sets the controller 68 to a default setting, which typically is the last stored setting or the maximum setting, which for sheet material A, B and C is 18 inches. In this way, when the dispenser 10 is used to dispense an unrecognized product, such as a product which the dispenser is not designed to dispense, it either dispenses the product at an arbitrary setting or at the maximum setting. Alternatively, the processor 66 may be designed to generate an output command in these instances which blocks operation of the controller 68 entirely so as to prevent operation of the electric motor 52, and hence dispensing of sheet material. Such a function is advantageous because the use of an unrecognized product can result in the jamming of the dispenser or in unsatisfactory dispensing of the product.

Figure 5:
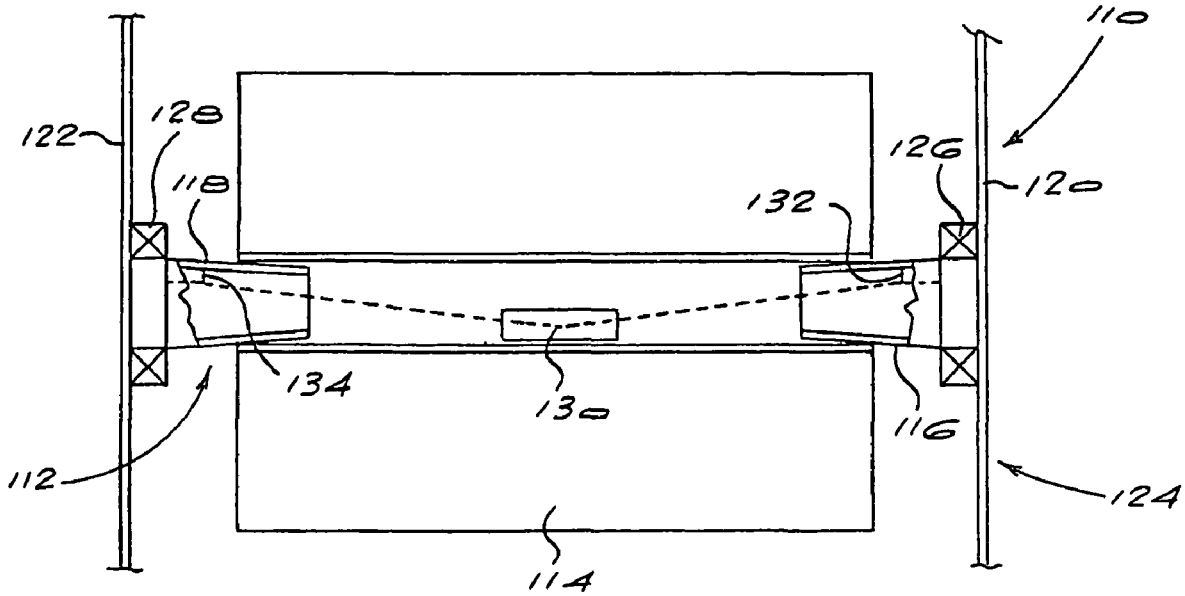
FIG. 5 is a cross-sectional view of a portion of a dispenser according to a another embodiment of the invention.

FIG. 5 illustrates a portion of a dispenser 110 according to a second embodiment of the invention. In this embodiment, a support 112 for a sheet material roll 114 includes a pair of mounting hubs 116 and 118 connected to side panels 120 and 122 (or a mounting module, such as that shown in FIG. 7) of a dispenser housing 124 by means of roll holders 126 and 128. As can be seen, the roll 114 carries a reflective label 130, and the support 112 includes an infrared emitter 132 in the mounting hub 116 and an infrared detector 134 in the mounting hub 118. The emitter 132 is arranged to emit angled infrared light into the core of the roll 114, as shown, which upon reflection off the reflective label 130 is detected by the infrared detector 134 to complete an infrared emitter/detector circuit. If an unauthorised product is inserted into the dispenser 110, the infrared emitter/detector circuit will not be completed, and typically the dispenser will default to a setting in which a relatively long length of sheet material is dispensed. Recognition of different rolls of sheet materials in this embodiment may be accomplished by adjusting the relative reflectivity of the label and therefore total reflected light for various sheet materials. Apart from the infrared emitter/detector circuit, the dispenser 110 is similar in all other respects to the dispenser 10 described above.

Figure 6:
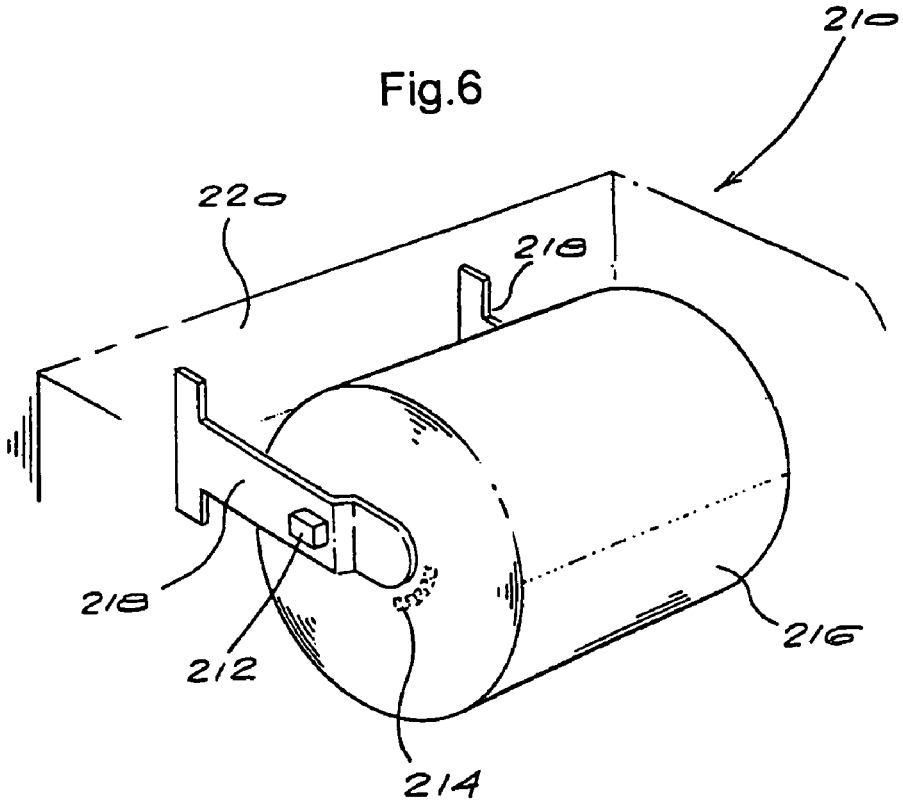
FIG. 6 is a perspective view of a portion of a dispenser according to a still another embodiment of the invention.

In FIG. 6 of the drawings, a portion of a dispenser 210 according to a third embodiment of the invention is seen to include a reader 212 for reading a logo 214, a bar code or the like which may be typically stamped or ink-jetted onto a side of a sheet material roll 216. It will be appreciated, however, that the bar code may be located anywhere on the roll 216. The reader 212 in this embodiment is desirably located on a support arm 218 for rotatably supporting the roll 216 within a dispenser housing 220, and is positioned so as to be aligned with the path of travel of the logo 214, although it will be appreciated that, like the bar code, the reader 212 may be positioned anywhere within the dispenser housing 216, so long as it operates as described herein. Accordingly, as the roll 216 rotates on the support arm 218, the logo 214 passes the reader 212 to identify the roll. Once the type of sheet material has been identified, the dispenser 210 is automatically set to dispense a suitable length of the sheet material. If an unrecognized product without the required marking 214 is inserted into the dispenser 210, a default setting typically will be assumed in which a relatively long length of sheet material is dispensed. Apart from the support arms 218 and the reader 212, the dispenser 210 is similar in all respects to the dispenser 10 described above.

It will be appreciated that the reader 212 may be configured to read and/or recognize a specific label, a specific logo, a magnetic strip, a hologram, and so forth. Accordingly, the present embodiment is intended as a non-limiting example.

A portion of a dispenser 310 according to a fourth embodiment of the invention is illustrated in FIG. 7 of the drawings. The dispenser 310 is similar in many respects to the dispenser 10, and differs only in that the dispensing mechanisms are mounted in a module 311, having, by way of non-limiting example, side walls 322 and at least a portion of a back wall 318, which is inserted into the dispensing housing 316. Otherwise, the dispenser 310 has the characteristics and operation of dispenser 10, as previously described herein.

Figure 8:
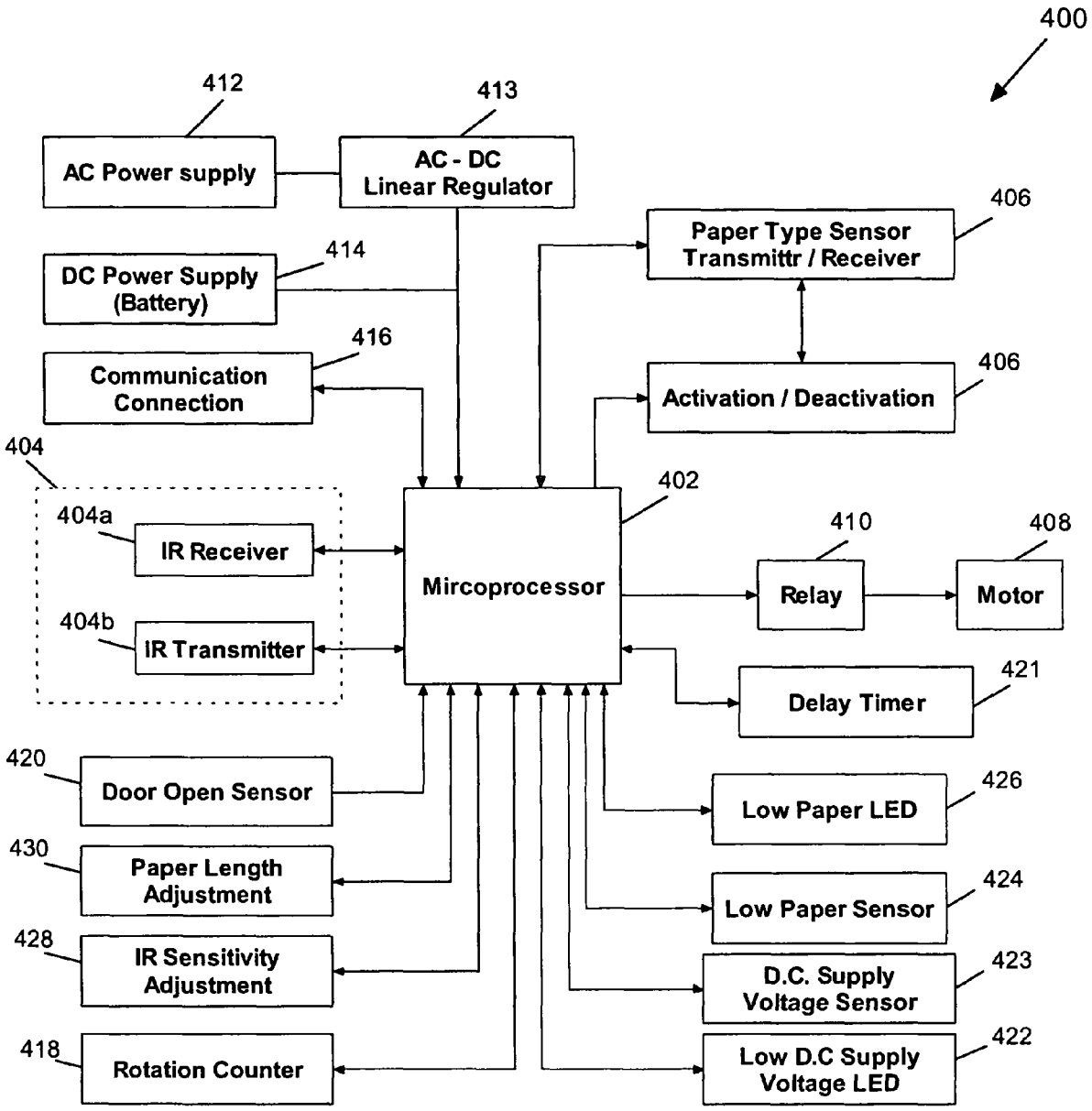
FIG. 8 is a block diagram of yet another embodiment of the present invention.

Referring now to FIG. 8, an alternative embodiment of a dispenser 10 controller 400 is presented. Controller 400 includes microprocessor or microcontroller 402 ("microprocessor" and "microcontroller" used interchangeably herein) activation sensor 404 (comprising IR receiver 404*a* and IR transmitter 404*b*), paper type sensor 406, motor 408, relay 410 and various sensors, timers, adjustors, and LED indicators (described in more detail later). Controller 400 is powered by either A.C. power source 412 or D.C. power source 414. A communication connection 416 is provided to facilitate programming/reprogramming of microcontroller 402 and/or communication between dispenser 10 and a remote computer.

Microcontroller 402 controls the functioning of dispenser 10 by executing code stored in a program memory. Ideally, microcontroller 402 has onboard program memory and data memory. Such memory is desirably a non-volitle memory; however, volitle memory may be used. One example of a suitable microcontroller is the PIC16F72 microcontroller (PICmicro® family) manufactured by Microchip Technology.

Microcontroller 402, motor 408 as well as individual components of controller 400 are powered by either A.C. power supply 412 or D.C. power supply 414. Desirably, a 120 Volt A.C. line input voltage is reduced to 12 volts using a transformer. The reduced voltage is rectified and feed into linear regulator 413 which maintains the desired D.C. voltage level required by controller 10. On possible embodiment of a D.C. power supply is a battery.

As previously noted for sensor 56, activation sensor 404 is a conventional passive sensor for detecting infrared (1R) radiation comprising a transmitter 404*a* and receiver 404*b*. Such passive infrared detectors are known in the art. IR transmitter 404*b* transmits a periodic (at random intervals or fixed intervals as desired) pulsed IR signal. IR receiver 404*a* is configured to detect reflected IR signals in the same pattern as the transmitted signal. When such a signal is detected, activation sensor 404 generates an output signal informing microcontroller 402 that sheet material or paper should be dispensed.

Desirably, paper length adjustments and IR sensitivity adjustments are performed automatically over communication connection 416 using a remote computer. It should be noted, however, that dispenser 10 allows for manual paper length adjustments and manual IR sensitivity adjustments using paper length adjustment 430 and IR sensitivity adjustments 418 respectively.

When microcontroller 402 determines that activation sensor 404 has been triggered and that dispenser 10 is ready to dispense paper, microcontroller 402 causes paper to be dispensed from dispenser 10 by engaging relay 410 thereby applying power to electric motor 408. As electric motor 408 turns, paper roll 14 turns and paper is forced out of the front of dispenser 10. As paper is being dispensed, microcontroller 402 monitors rotation counter 418 which outputs a signal for each motor rotation (or paper roll 14 rotation, or fraction thereof). When rotation counter 418 generates a predefined number of rotation signals, microcontroller 402 disengages relay 410 thereby removing power to motor 408. Thus, one of ordinary skill in the art will recognize that the length of paper that is dispensed can be controlled by manipulating the predefined number of rotation signals microcontroller 402 looks for (i.e. the value at which microcontroller 402 turns off motor 408).

Before engaging relay 410, microcontroller 402 checks the status of Delay timer 421. The purpose of delay timer 421 is to prevent consecutive paper dispensing events until a predefined amount of time elapses. Upon disengaging relay 410 after a paper dispensing event, delay timer 421 is activated. While delay timer 421 is active, microcontroller 402 disables relay 410. Delay timer 421 is designed to "time out" after a predefined amount of time. Such functionality can be achieved using a count down timer, a count up timer or any other suitable timing technology. For example, delay timer 421 could be set to "time out" ten seconds after activation. For such a configuration, consecutive paper dispensing events could not occur faster than once every ten seconds.

Before engaging relay 410, microcontroller 402 checks the status of door open sensor 420. When a user opens front cover 24 to replace paper roll 14 or otherwise service dispenser 10, open door sensor 420 asserts a door open signal that is sensed by microcontroller 402. Upon sensing a door open signal, microcontroller 402 disables relay 410 thereby disabling electric motor 408.

Microcontroller 402 monitors the output of sensor 423. D.C. voltage sensor 423 monitors the output voltage level of D.C. power supply 414. If such voltage level drops below a predefined amount, microcontroller 402 asserts a voltage signal to low D.C. supply voltage LED 422. When such a low signal is asserted, LED 422 will emit light informing a user that the D.C. power source (perhaps a battery) is not providing the proper power to controller 400.

Microcontroller 402 also monitors low paper sensor 424. One method of sensing a low paper condition may be accomplished using a mechanical arm that rides on paper roll 14. As paper from paper roll 14 is dispensed from dispenser 10, paper roll 14 shrinks in size. Eventually such mechanical arm will activate low paper sensor 424 and a low paper signal will be asserted. When microcontroller 402 detects a low paper signal, microcontroller 402 asserts a signal to low paper LED 426 and LED 426 will emit light informing a user that the paper source is almost depleted.

Attention is now directed to paper type sensor transmitter/receiver 406. When a user opens front cover 24 to replace paper roll 14 or otherwise service dispenser 10, open door sensor 420 asserts a door open signal that is sensed by microcontroller 402. Microcontroller 402, in turn, activates the transmitter/receiver associated with the paper type sensor transmitter/receiver 406. One possible embodiment of a paper type sensor transmitter/receiver is an RFID based sensor. Ideally, paper roll 14 is associated with an RFID smart tag. For such a configuration, paper type sensor transmitter/receiver 406 transmits an RFID smart tag trigger signal and listens for transmissions from RFID smart tags associated with paper roll 14. At least part of the received smart tag data is stored in a memory associated with microcontroller 402. Such smart tag data ideally comprises paper type identification information. Such information may be used by microcontroller 402 to automatically configured dispenser 10 operation based on the type of paper inserted into dispenser 10.

Figure 12:
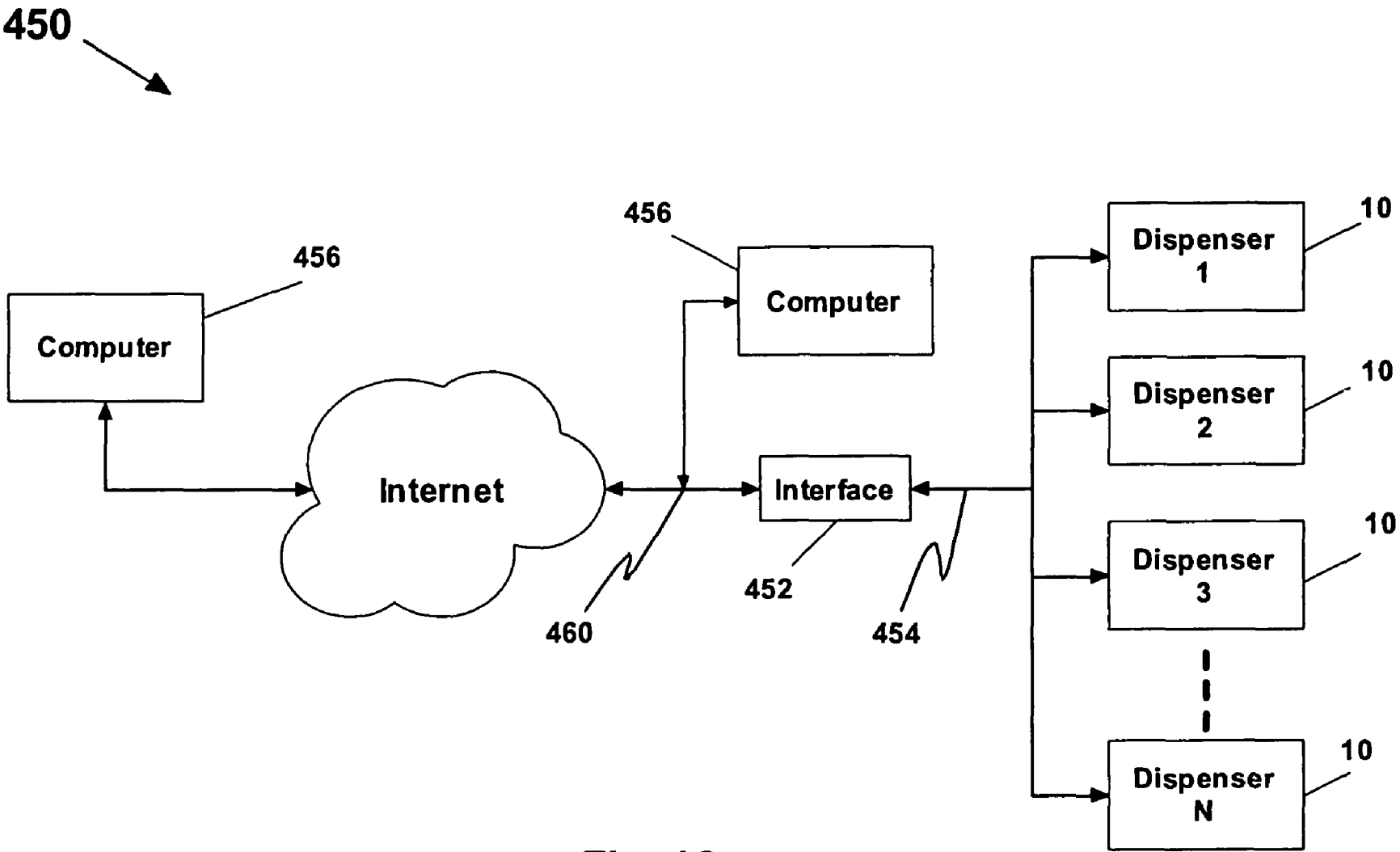
FIG. 12 is a block diagram of still yet another embodiment of the present invention.

Now referring to FIG. 12, a network enabled dispenser system 450 is depicted. Multiple dispenser 10 devices are shown all interconnected to remote computer 456 via interface 452 and through wired or wireless communication link 454. Such communication technology is well known in the art and includes Wi-Fi (wireless fidelity) and Bluetooth.

Interface 452 may comprise a gateway for connecting two otherwise incompatible systems or for simply providing a connection between two compatible systems. As used herein, a gateway is an electronic device that connects two otherwise incompatible systems or that simply provides a connection between two compatible systems. Interface 452 may also be incorporated into remote computer 456.

For such a configuration, a TCP/IP protocol suite may be incorporated into Interface 452 providing a gateway between remote computers connected to communications link 454 and dispenser 10 devices which ideally enables continuous remote access to such devices. The gateway may incorporate an HTTP server for accessing data from multiple dispenser 10 devices and for transmission of data to individual dispenser 10 devices.

In the above described system 10 configuration, communications link 406 provides access to a first network (such as the Internet) operating in accordance with a predetermined protocol (TCP/IP is one example). A plurality of dispenser 10 devices may comprise a second network, such as a LAN. A gateway (Interface 452) operatively couples the first network to the second network. Finally, an HTTP server is embedded in either the gateway or the plurality of dispenser devices facilitating the transfer of data between the two networks. With such a configuration, one of ordinary skill in the art will appreciate that individual dispenser 10 devices or groups of dispenser 10 devices may be accessed as if such devices were a web site and their information could be displayed on a web browser. Such technology is fully disclosed by Ardalan et al. in U.S. Pat. No. 6,363,057 for use in a system for communicating with electricity meters, which is hereby incorporated by reference for all purposes.

Exemplary algorithms for controlling dispenser 10 are now considered. Such algorithms include a Dispense Paper routine, a Check Dispenser Status routine, and a Paper routine. Ideally, such algorithms, in the form of programming code, would be stored in a nonvolatile memory associated with processor 66 or microcontroller 402. Hereafter, however, processor 66 will be described as executing the disclosed algorithms. Typically, when dispenser 10 is powered up or reset, after performing the necessary startup routines, processor 66 would access and execute such programming code as required. It should be appreciated, however, that such programming code may be executed by any processor associated with dispenser 10.

Figure 9:
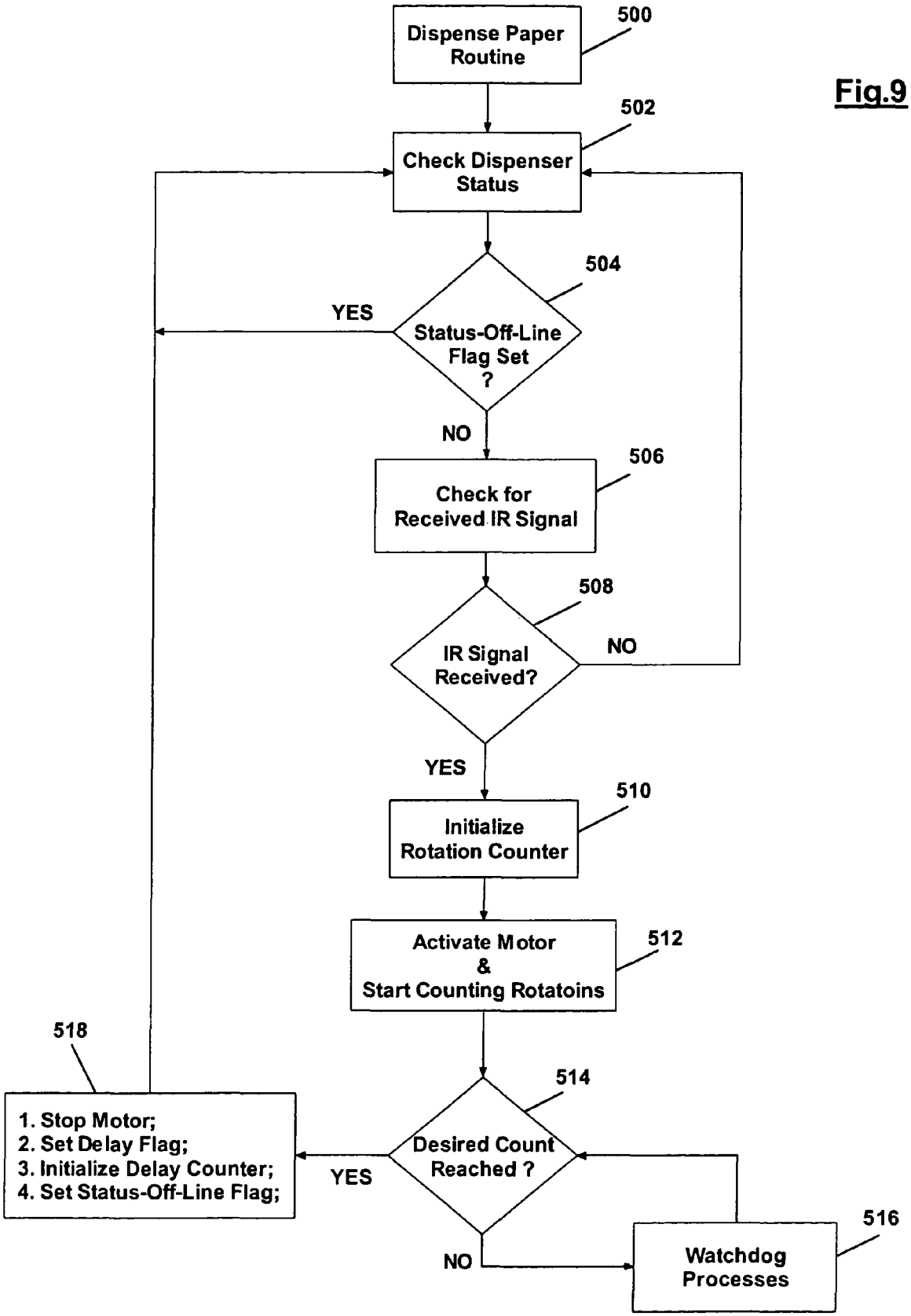
FIG. 9 is a logic chart of a dispense paper routine.

Referring now to FIG. 9, a high level block diagram of an exemplary Dispense Paper routine is presented. Step 500 marks entry into the Dispense Paper routine. At step 502, the status of dispenser 10 is checked by executing exemplary Check Dispenser Status routine which is described in more detail later. Generally speaking, the Check Dispenser Status routine evaluates the state of the various sensors associated with dispenser 10 and "sets" a Status-Off-Line flag if dispenser 10 is not ready to dispense paper or "resets" such Status-Off-Line flag if dispenser 10 is ready to dispense paper. At step 504, the value of the Status-Off-Line flag is examined. If the Status-Off-Line flag is set, dispenser 10 is not ready to dispense paper and program control returns to step 502 and the Check Dispenser Status routine is again executed. Such a loop will continue until the Check Dispenser Status routine determines that dispenser 10 is ready to dispense paper and resets the Status-Off-Line flag.

If at step 504, processor 66 determines that the Status-Off-Line flag is not set (i.e. the Status-Off-Line flag has been reset), program control passes to step 506 where processor 66 checks for a signal indicating that paper should be dispensed. For the disclosed exemplary embodiment, processor 66 checks for a received IR signal having a predefined pattern. If the appropriate IR signal has been received, a rotation counter is initialized (step 510) and program control passes to step 512 where electric motor 52 is activated. As electric motor 52 turns, paper towel roll 14 turns and the rotation counter is incremented. At step 514, processor 66 evaluates the rotation counter value to determine if the desired number of rotations has been recorded. If the desired rotation counter value has not been recorded, an optional "watchdog" process may be performed (step 516).

A "watchdog" process is simply a process designed to prevent endless loops. For example, if electric motor 52 has malfunctioned, the desired rotation counter value will not be reached as electric motor 52 will not turn. For such a situation, and without a watchdog process, the processor 66 will be caught in an endless loop where it continuously checks the rotation counter value. If electric motor 52 is consuming power during such a situation, there will be unnecessary power consumption (particularly undesirable for battery power embodiments) and the electrical components that control electric motor 52 will be unnecessarily stressed reducing product life. Exemplary watchdog processes may include checking for paper movement and monitoring elapsed time. Ideally, when an error condition is detected, the watchdog process would disable the motor drive circuits and report the error condition.

After step 516, program control passes back to step 514 and processor 66 again evaluates the status of the rotation counter value. If the desired rotation counter value has been recorded, then program control passes to step 518 where power to electric motor 52 in interrupted, a Delay Flag is set, Delay Counter is initialized, and the Status-Off-Line flag is set. Program control then passes back to step 502 and the Check Dispenser Status routine is executed.

Figure 10:
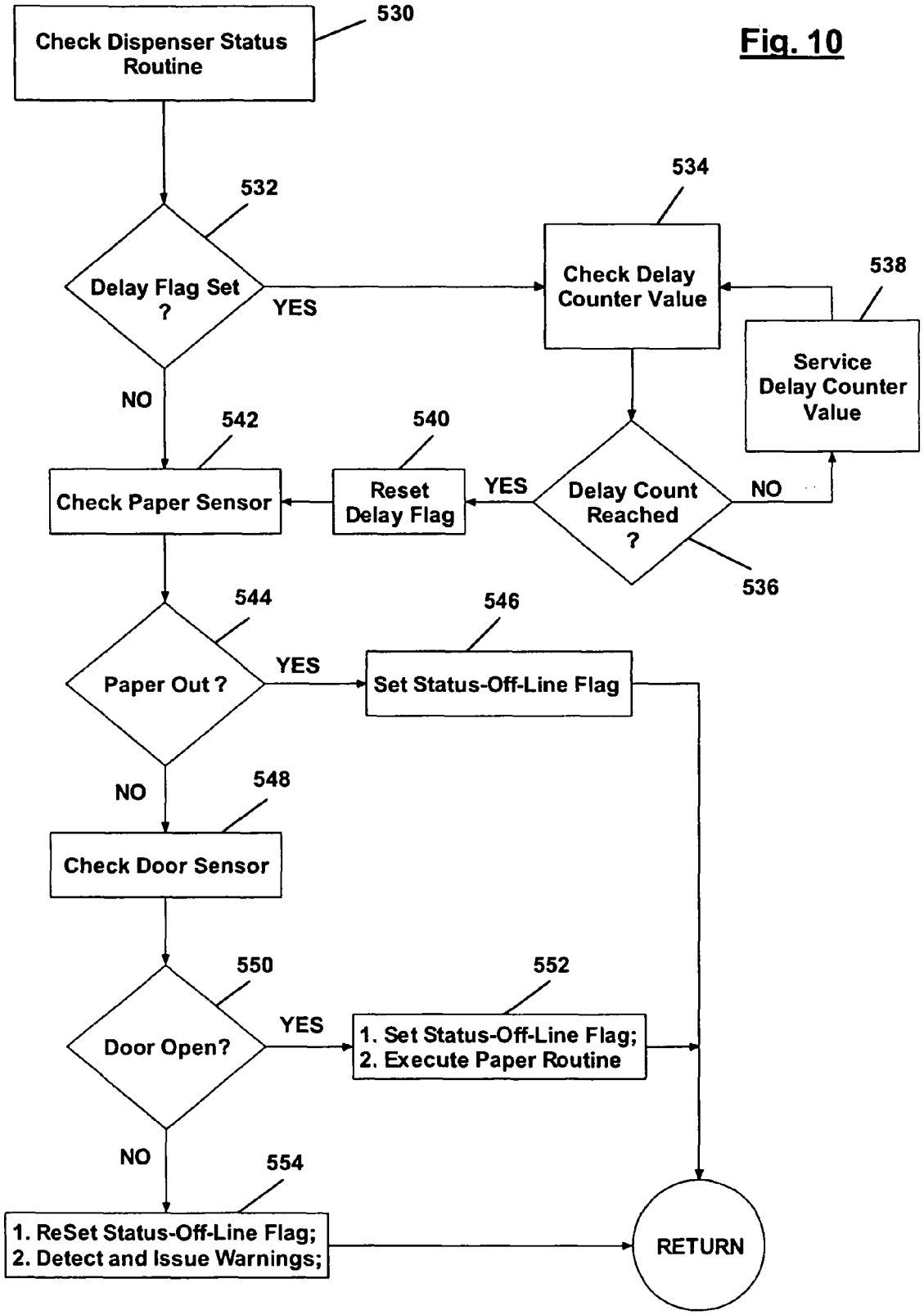
FIG. 10 is a logic chart of a check dispenser status routine.

Referring now to FIG. 10, step 530 marks the entry into an exemplary Check Dispenser Status routine. Upon entry into such routine, the status of the Delay Flag is checked (step 532). If the Delay Flag is set, then program control passes to step 534 and a delay counter value is examined (step 536). If a predefined delay counter value has been reached, then the Delay Flag is reset (step 540) and program control passes to step 542. If, however, such predefined delay counter value has not been reached, the delay counter value is serviced (step 538) and program control returns to step 534. Such delay counter value may be a count down timer, a count up timer, an elapsed time monitor, or any other suitable process for monitoring the passage of time. Exemplary methods of servicing a delay counter value include incrementing a counter value, decrementing a counter value, and updating a time value.

Returning to step 532, if the delay flag is not set, then program control passes to step 542 and the status of the paper sensor is examined. Such a paper sensor ideally determines when dispenser 10 is out of paper. If the paper sensor indicates that the paper supply in dispenser 10 has been depleted, then the Status-Off-Line flag is set and program control returns to the calling routine (i.e. the Dispense Paper routine). If at step 544 the paper sensor indicates that the paper supply in dispenser 10 has not been depleted, then program control passes to step 548.

At step 548, a door sensor is evaluated. Such a door sensor ideally determines when a dispenser 10 access means (such as front cover 24) has been opened (perhaps to service dispenser 10). If the door sensor indicates that a monitored access point has been opened, the Status-Off-Line flag is set and a Paper routine (described herein) is executed. When program control returns from the Paper routine, program control returns to the calling routine (i.e. the Dispense Paper routine).

Returning to step 550, if the door senor indicates that no monitored access points have been opened, program controls passes to step 554. At step 554, the Status-Off-Line flag is reset (i.e. dispenser 10 is ready to dispense paper). Optionally, a Detect and Issue Warnings routine (not disclosed) may be executed at this point. Such a routine would check the status of warning sensors, such as low battery, low paper, etc. and issue warnings (such as turning on an LED or transmitting a signal/message to a remote device) when necessary. After resetting the Status-Off-Line flag, program control returns to Dispense Paper routine.

Figure 11:
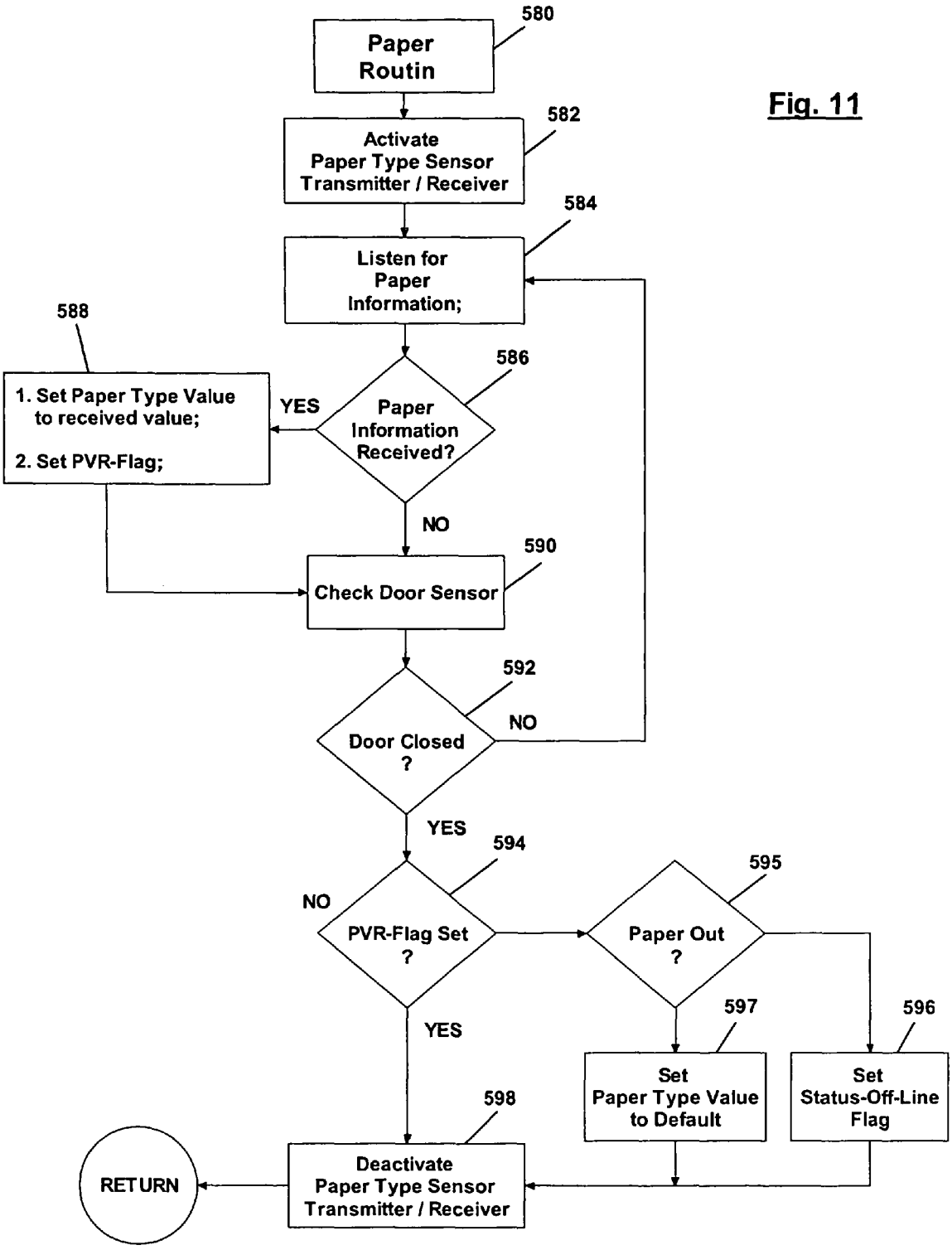
FIG. 11 is a logic chart of a paper routine.

Referring now to FIG. 11, step 580 marks the entry into an exemplary Paper routine. The general purpose of the Paper routine is to automatically detect the type of paper inserted into dispenser 10 and automatically configure dispenser 10 according to predefined paper dispensing parameters associated with the detected paper type. Such dispensing parameters may include the length of the paper to be dispensed and/or the delay between consecutive paper dispensing events. At step 582, processor 66 activates the paper type sensor's transmitter and receiver and listens for paper information (584). For example, if the paper type sensor is an RFID based sensor, an RFID trigger signal is transmitted to trigger RFID smart tag transmissions and a receiver circuit listens for such smart tag transmissions.

Such transmissions ideally comprise paper information associated with the type of paper inserted into dispenser 10. As noted above, such paper information may be used, for example, to determine the length of paper to be dispensed and the delay between dispensing events. Thus, paper information may include two counters values; the rotation counter value (step 512) and the delay counter value (step 534). Alternatively, such paper information may be a simple code that is used to retrieve/access the appropriate paper type information from a memory associated with processor 66. At step 586, if processor 66 determines that valid paper information has been received, then a Paper-Type-Value is set consistent with the received paper type information. Additionally, a PVR-Flag is set (PVR—Paper Value Received). The PVR-Flag is used to document the receiving of valid paper information.

Returning to step 586, if processor 66 determines that no valid paper information has been received, the status of the door sensor is checked (step 586) in the same or similar manner as is done in step 548 (FIG. 10). If the door sensor indicates an access point has not closed, program control jumps back to step 584. If, however, the door sensor indicates that the access points have been closed, program control passes to step 594 and the status of the PVR-Flag is checked.

If the PVR-Flag has been set, program control passes to step 598. At step 598, the paper type sensor transmitter/receiver may be deactivated and program control returns to the calling routine, in this case, the Check Dispenser Status routine.

If, however, at step 594 the PVR-Flag has not been set, program control passes to step 595. At step 595, the paper sensor is checked in the same or similar manner as in step 542 (FIG. 10). If the paper sensor indicates that there is paper in dispenser 10, then an unknown paper type is deem to have been inserted into dispenser 10. Under such conditions, the paper type value is set to a default value (step 597). Such a default value may simply be the previous paper type value (i.e. no change in value) or it may be a predefined value specifically used for unknown paper types. Next, at step 598, the paper type sensor transmitter/receiver may be deactivated and program control returns to the calling routine. If, however, at step 595 the paper sensor indicates that there is no paper in dispenser 10, the Status-Off-Line Flag is set and program control passes to step 598.

Although the invention has been described above with reference to dispensers which automatically dispense sheet materials with the aid of an electric motor, it will be appreciated that the dispenser could include a manually operated lever or the like for drawing sheet materials off a sheet material roll. In manually operated dispensers with levers, the controller would be arranged to limit the operation of the lever, for example the number of strokes that can be effected or the extent of each stroke (not shown).

An advantage of the dispenser according to the present invention is that it automatically controls the lengths of sheet materials dispensed. Accordingly, there is no need for an operator to adjust the dispenser in order to effect a change in the lengths of sheet materials dispensed. Furthermore, the dispenser is efficient in that it allows for the automatic dispensing of relatively short lengths of more absorbent products, and relatively longer lengths of less absorbent products. Also, the dispenser detects the loading of an unrecognized product, which is usually a less expensive and less absorbent sheet material product, and defaults to a greater length of sheet dispensed. In this way, the dispenser dispenses a single sheet in order to provide user satisfaction in using the single sheet for a hand drying episode, no matter whether a highly absorbent or less absorbent sheet material product is dispensed.

It should be understood that the dispenser of the invention is not limited to the dispensing one type of sheet material, such as paper towels. On the contrary, the dispenser could also be used to dispense various other types of sheet material, such as, but not by way of limitation, facial sheets, bath tissue sheets, wipers, and so forth.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A method of dispensing a web of sheet material from a continuous roll, the method comprising:

providing a roll of sheet material which includes identification relating to absorbent characteristics of sheet material on the roll;

rotatably supporting the roll of sheet material adjacent an identifier in a dispenser housing;

identifying the absorbent characteristics of sheet material on the roll;

processing data relating to the absorbent characteristics of sheet material on the roll to generate an output command; and controlling a length of sheet material dispensed from the roll in response to the output command.

2. The method of claim 1, wherein the identifier comprises a reader, and the step of identifying the absorbent characteristics of sheet material on the roll comprises reading data from identification on the roll of sheet material.

3. The method of claim 2, wherein the step of reading data comprises reading data from a label, a logo, a bar code, a magnetic strip, a RFID, or a hologram on the roll of sheet material.

4. The method of claim 2, wherein the step of reading data comprises reading data from identification on a core of the roll of sheet material.

5. The method of claim 2, wherein the step of reading data comprises reading data from identification on the sheet material.

6. The method of claim 2, wherein the step of identifying the absorbent characteristics of sheet material on the roll includes decoding encoded identification on the roll of sheet material.

7. The method of claim 2, wherein the step of reading data comprises reading data from an RFID tag embedded in or attached to the core of the roll of sheet material.

8. The method of claim 1, wherein the step of identifying the absorbent characteristics of sheet material on the roll comprises emitting infrared light into the core of the sheet material roll, and detecting reflection of the light off reflective identification on the core of the roll.

9. The method of claim 1, including the step of activating the identifier when the dispenser housing is opened so as to allow for identification of the absorbent characteristics of sheet material on a roll inserted onto the support.

10. The method of claim 9, including the step of deactivating the identifier after identification of the sheet material on the roll.

11. The method of claim 1, including the step of providing a delay between successive dispensing operations.

12. The method of claim 1, including the step of dispensing the length of sheet material with an electric motor.

13. The method of claim 1, including the step of dispensing the length of sheet material in response to sensing a user's hand adjacent the dispenser housing.

* * * * *